US006679326B2

(12) United States Patent
Zakiewicz

(10) Patent No.: US 6,679,326 B2
(45) Date of Patent: Jan. 20, 2004

(54) PRO-ECOLOGICAL MINING SYSTEM

(76) Inventor: Bohdan Zakiewicz, #1: 427 14th St., Santa Monica, CA (US) 90402

( * ) Notice: Subject to any disclaimer, the term of this patent is extended or adjusted under 35 U.S.C. 154(b) by 0 days.

(21) Appl. No.: 10/047,533

(22) Filed: Jan. 15, 2002

(65) Prior Publication Data

US 2003/0131989 A1 Jul. 17, 2003

(51) Int. Cl.[7] ..... E21B 43/22; E21B 43/241; E21C 41/16

(52) U.S. Cl. ..... 166/272.5; 166/245; 166/272.3; 166/402; 299/5; 299/17

(58) Field of Search ..... 166/268, 209, 166/272.1, 272.3, 401, 402, 272.6, 272.5, 275, 245; 299/2–6, 10, 16, 17

(56) References Cited

U.S. PATENT DOCUMENTS 2,796,129 A * 6/1957 Brandon ..... 166/249
3,386,508 A * 6/1968 Bielstein et al. ..... 166/272.3
4,221,433 A * 9/1980 Jacoby ..... 299/4
4,249,775 A 2/1981 Zakiewicz
4,253,703 A * 3/1981 Fonseca et al. ..... 299/5
4,257,650 A * 3/1981 Allen ..... 166/272.3
4,289,354 A 9/1981 Zakiewicz
4,305,463 A 12/1981 Zakiewicz
4,465,136 A * 8/1984 Troutman ..... 166/402
4,502,733 A * 3/1985 Grubb ..... 299/2
4,532,986 A * 8/1985 Mims et al. ..... 166/50
4,550,779 A 11/1985 Zakiewicz
4,565,245 A * 1/1986 Mims et al. ..... 166/50
4,605,069 A 8/1986 Mclaflin et al.
4,646,836 A * 3/1987 Goodhart ..... 166/303
4,852,666 A * 8/1989 Brunet et al. ..... 175/61
4,869,555 A 9/1989 Peters et al.
5,016,710 A * 5/1991 Renard et al. ..... 166/245
5,782,133 A * 7/1998 Kullborg ..... 74/420
6,024,171 A * 2/2000 Montgomery et al. ..... 166/308
6,318,468 B1 11/2001 Zakiewicz
6,321,840 B1 * 11/2001 Billiter et al. ..... 166/268
6,478,085 B2 * 11/2002 Zupanick ..... 166/50

* cited by examiner

*Primary Examiner*—David Bagnell
*Assistant Examiner*—Jennifer H Gay
(74) *Attorney, Agent, or Firm*—David T. Bracken

(57) ABSTRACT

The invention comprises a high pressure fluid barrier forming an enclosure boundary with respect to overburden and floor strata separated by one or more production strata containing desirable fluidizable deposits and/or potential reaction materials. A centrally located Super Daisy Shaft delivers a highest pressure fluid to the enclosure boundary by way of envelope conduits extending laterally horizontal and/or downward from the Super Daisy Shaft (or a trench from which such conduits may also extend) into the production strata.

17 Claims, 12 Drawing Sheets

PRO-ECOLOGICAL MINING SYSTEM

BACKGROUND OF THE INVENTION

The present invention relates to recovery and treatment of underground mineral deposits by a multitude of directional and multi-functional wells drilled from the super daisy shaft through which the dynamics and dragging forces of fluid means is developed synergistically with complex rubblization and other techniques, and more particularly where the part of the array of wells assist in creation of the pressurized barriers to contain the exploitation field for treatment and recovery of minerals.

For example for one of the minerals: Sulfur, the recovery from underground deposits has been attempted with some limited success. In the period 1891–1915, Herman Frasch obtained patents for the Frasch mining method. This method was initially developed for diapiric salt domes located in the area of the Gulf of Mexico. The salt domes in their uppermost parts, called "cap rock", also contain native sulfur deposits that are encapsulated and insulated from the surrounding permeable rocks by thick crusts of clay formations. The "Frasch-able" deposits were so well sealed, that as an example, one of the mines "OLD GULF" in Texas, which was reopened after 33 years of dormancy, has retained almost its original production pressure and temperature, exceeding 80° C.

The Frasch method used injection of super-heated water at 160° C. into the encapsulated deposit, which melts and accumulates sulfur within the deposit. With use of an airlift, the sulfur is pumped out from the underground deposit to the surface by a randomly placed vertical combination well, which both injects hot water and receives the molten sulfur from the deposit. The injected hot water passes slowly through the confined, autoclave-like deposit, losing its temperature as it rises to the surface through so-called "bleed-water wells" to dumping reservoirs. It was assumed that to economize heat losses, the bleed-water wells ought to be situated at the most remote peripheral parts of the deposit.

The Frasch method cannot be used for bedded type sulfur deposits, which were discovered in abundant amounts in Poland in 1953 (over one billion tons of mineable crystalline sulfur), followed by later discoveries in Russia (one hundred million tons of crystalline sulfur) and in Irag (two hundred million of crystalline sulfur). Bedded type deposits in Poland and Iraq were shallower than the salt domes in USA, and were often outcropped to the surface and spatially uninsulated. The Frasch method required at least a contained pressure of 8 bars and a melting temperature of 160° C. for operation. Bedded deposits with outcrops obviously cannot be recovered with the Frasch method.

The present inventor disclosed in Sulfur Magazine, *Exploitation of Bedded Sulfur Deposits by the Hydrodynamic Method*, No. 120/1975, a method with international industrial application. Additional improvements were disclosed in U.S. Pat. No. 4,249,775 and in *Recent Developments in Sulfur Mining By Underground Melting. Thermofluid Mining of Sulfur Deposits*, B. Zakiewicz, Sulfur Magazine No. 184/1986. These improvements introduced re-circulation for the production water through the sulfur deposit for sulfur recovery and also re-circulation of brine throughout salt formations for recovery of mineral salts by pumping those liquids about submersible pumps and/or hot gasses. The conventional need for chemical treatment of recycled water was thereby avoided, and scale was eliminated in required heat exchangers. Recycled water being highly saturated with ions did not dissolved the carbonaceous sediment matrix and by the same prevents collapsing subsidence of the deposit structure. The distribution of the inclined production/injection wells was better organized to avoid a big energy losses in heat carrying pipelines In addition, catalytic combustor became well known and used as a soot-free heat source as well as for injectable combustion gases, which reduced energy consumption, improved the overall economy of recovery and eliminated any heat losses and pollution releases to the atmosphere. U.S. Pat. No. 4,869,555 discloses a method for hot water sulfur recovery with similar recycle of production water.

The maximum recoverability achieved in "Frasch-able" deposits usually could not exceed 35% of original geological reserves (recovery ratio). The latter was exemplified by the total of forty exploited deposits, which were exceptionally rich and promising for the Frasch method applied. More than 50% of the production wells hitherto were terminated prematurely as a consequence of poorly working sulfur pumping systems in the low productivity wells. Cool, compressed air delivered into a low productivity well, results in sulfur solidification and subsequent liquidation of the well.

U.S. Pat. No. 4,289,354 by B. Zakiewicz, discloses the underground bore-hole mining of bituminous coal gasification projects for a pyrolytic process for fluidization of coal. The pyrolytic process is performed with injected oxygen, and control of the combustion pressure and temperature in the chamber is accomplished by its containment by concrete walls built along mining tunnels that outline the production field. Combustion is performed through drilling wells from the surface. The resulting lean pyrolytic gas had heating value of 3,351 kcal per cubic meter, capable of commercial use. Similar processes without containment in USA, Belgium and England have delivered pyrolytic gas having heating value of 2,469 kcal per cubic meter. It is evident from the above processes, that pyrolytic gasification requires densely spaced production wells.

U.S. Pat. Nos. 4,289,354 (Zakiewicz), 4,305,463, 4,550,779, 4,289,354, and 6,318,468 (Zakiewicz) disclose heavy crude recovery, where thermofluid and thermochemical processes are applied. The specific gravity of heavy crude could be 10° API and below. In these processes "daisy" wells were drilled with inclined six-leg extensions. The recycled high temperature fluids, enriched with organic solvents, were employed to fluidize and displace slow or non-flowable heavy crude. The complex combination of various techniques have produced large amounts of heavy and processed crudes, with or without use of vaporized organic solvents and catalytic combustors, generating soot-free combustion gases to carry heat to the formations.

None of the known so called "Bore-Hole" methods was able to develop a barriering dynamic confinement of the selected part of the sulfur, coal or crude-oil deposits as being developed at the peripheral circumference (enclosure boundary) of the mining field from one central point, which is the Super Daisy shaft. None of the existing methods was able to provide rubblization of the deposit synergistically with fluidization of the mineable miners and displacement of flowable minerals by dragging forces along both direction: centripetal from distant peripheral parts of the mining field towards centrally located collecting point and spiral- circular flows with turbulent swirling within confined mining field.

None of the existing methods exemplified in sulfur bore-hole mining was able to be utilized in mining the other minerals, practically with no significant adaptations, as it is possible in present invention.

SUMMARY OF THE INVENTION

The present invention is almost universally applicable for recovery, producing and processing of crystalline sulfur, heavy and light oil crude, natural free gas and its hydrates, pyrolitic and/or synthetic oil & gas from bituminous coal, brown coal and lignite, steam from underground combustion chambers in coal, salt leaching, uranium and other metals deposits leaching, biological mining, large systems of groundwater dewatering, large systems for toxic and radioactive underground disposal storage, strategic underground gas and petroleum storage, large groundwater intake systems, to name only the major applications.

The present invention comprises a synergistic confinement of the deposit by high pressure fluid barrier forming an enclosure boundary with respect to overburden and floor strata separated by one or more production strata containing desirable fluidizable deposits and/or potential reaction materials with simultaneous action of rubblization, mineral fluidization and dynamic-turbulent, centripetal displacement of fluidized minerals from the boundary strata of the mining field towards collecting point, which is Super Daisy Shaft. A centrally located Super Daisy Shaft delivers a highest pressure fluid to the enclosure boundary by way of envelope conduits extending laterally horizontal and/or downward from the Super Daisy Shaft (or a trench from which such conduits may also extend) into the production strata. Recovery conduits with ends within the envelope barrier inject lower pressure fluids and/or recover deposit fluids that are brought to the surface through the same Super Daisy Shaft. By withdrawal of higher pressure fluids and desired fluids from the product strata, the recovery conduits create a lower pressure well within the envelope high pressure barrier, thereby forming a circulation of production strata fluids from the envelope barrier centripetal toward the Super Daisy Shaft. In addition, within the envelope, the pressure in each individual directionally drilled well is diversified in a way which develops spiral-circular and centripetal flow of the fluidized mineral. This movement is resulted by dragging forces developed with use of large volume of the mobilizing and producing heat carrier, which can be water, steam or gasses. Jet pumps operating at the recovery conduit ends may be controlled in withdrawal of production strata materials so that a preferable pressure gradient is developed from the envelope barrier at high pressure to a recovery conduit at or near the Super Daisy Shaft.

Fluid flow along the described pressure gradient from the outer enclosure boundary to the Super Daisy Shaft creates and establishes production strata paths that with continuous fluid flow advantageously increase in size to extensively erode and/or free up desirable fluids from the production strata for recovery to the surface.

The present invention is useful in major classes of underground operations. Crude oil, sulfur and other minerals exist in production strata so that they can be recovered with the invention process. Similarly, pyrolytic gas and steam from underground coal can be more efficiently produced with the invention process, as well as recovery of desirable fluids from bacterial digestion of underground materials.

DETAILED DESCRIPTION OF THE INVENTION

The invention is now discussed with reference to the Figures.

Figures 1, 2:
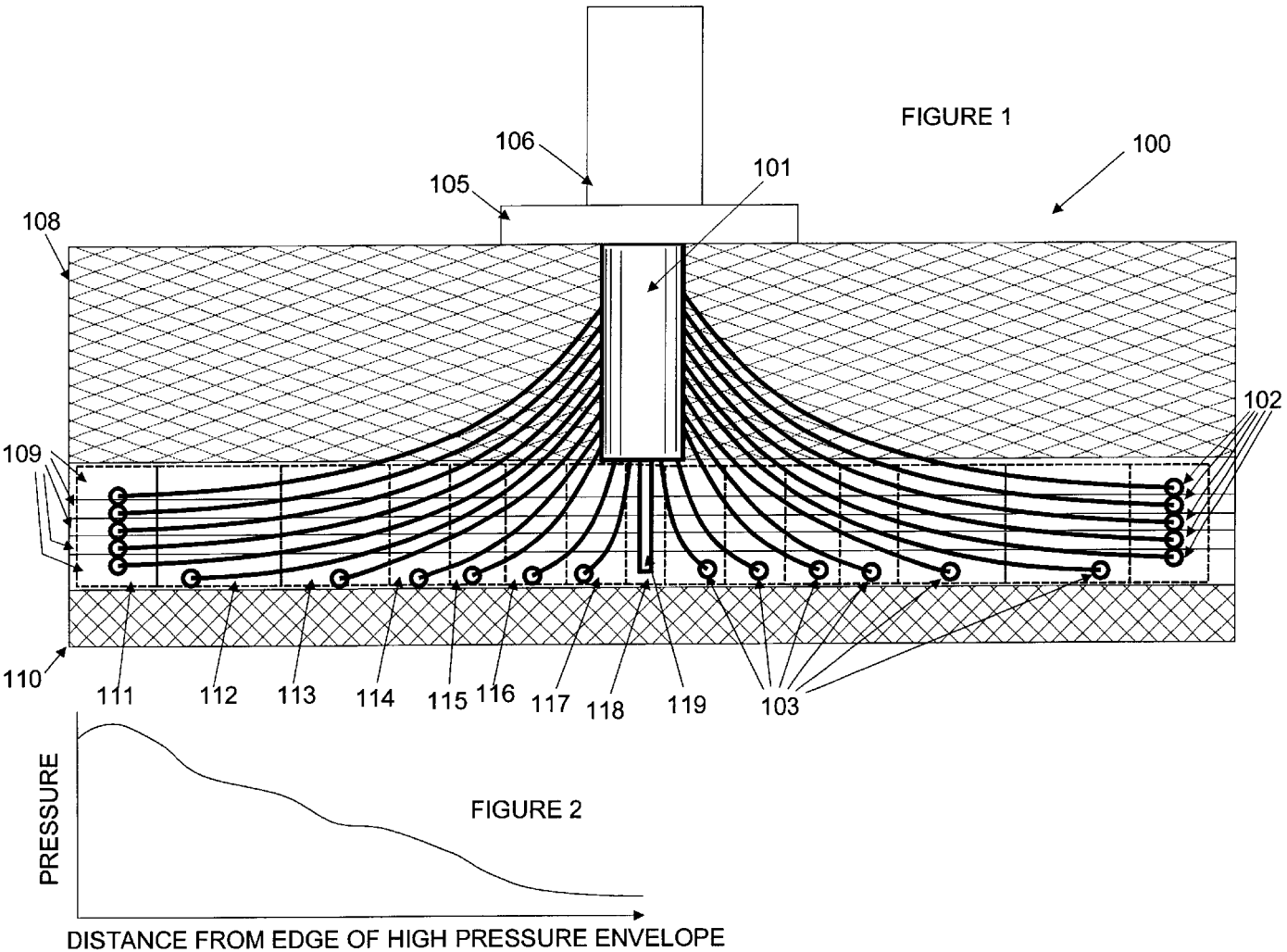
FIG. 1 is a cutaway side view of the invention process showing a central Super Daisy Shaft and lateral conduits extending from it into production strata.
FIG. 2 is a general preferred pressure gradient established from the enclosure boundary to the Super Daisy Shaft shaft.
Figure 5:
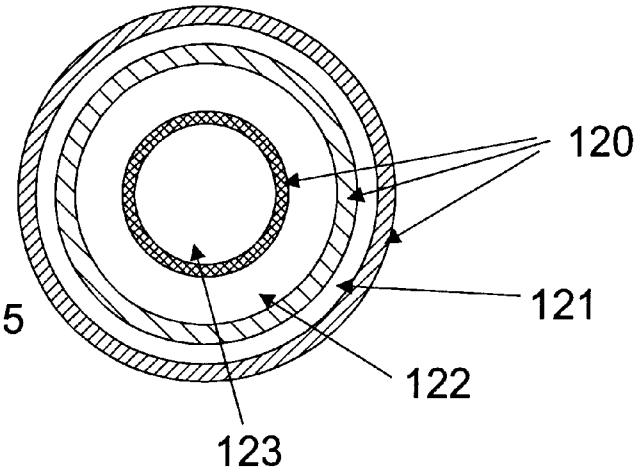
FIGS. 5 and 6 are respectively a radial cross section and end axial cross section of a Jet-Stinger conduit used in the invention method.
Figure 6:
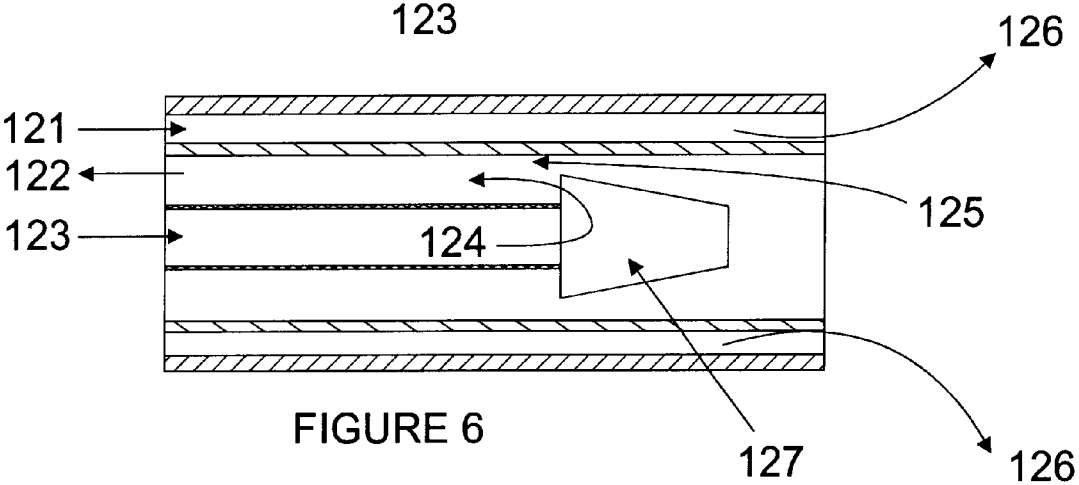

FIG. 1 comprises an invention field 100 having an overburden strata 108 and a floor strata 110 having between them production strata 109 containing desirable fluid or fluidizable material and/or potential reaction material resulting in desirable fluidizable material. Jet-Stingers 102 and 103 extend from manifolded heads (not shown) in superstructure 105 and 106, through Super Daisy Shaft 101, sealingly through the wall of Super Daisy Shaft shaft 101 and laterally to locate Jet-Stinger ends in production strata 109. Jet-Stingers 102 are envelope conduits and Jet-Stingers 103 and central well 118 are recovery conduits. FIGS. 5 and 6 show that Jet-Stingers 102 and 103 comprise three conduits 120 defining hot gas path 121, recovery fluid path 122 and jet pump drive fluid path 123 where fluid in path 123 is used to drive jet pump 127 to recover fluid 125 into path 122 and where path 121 is used to deliver to production strata hot gas 126.

Figures 3, 4:
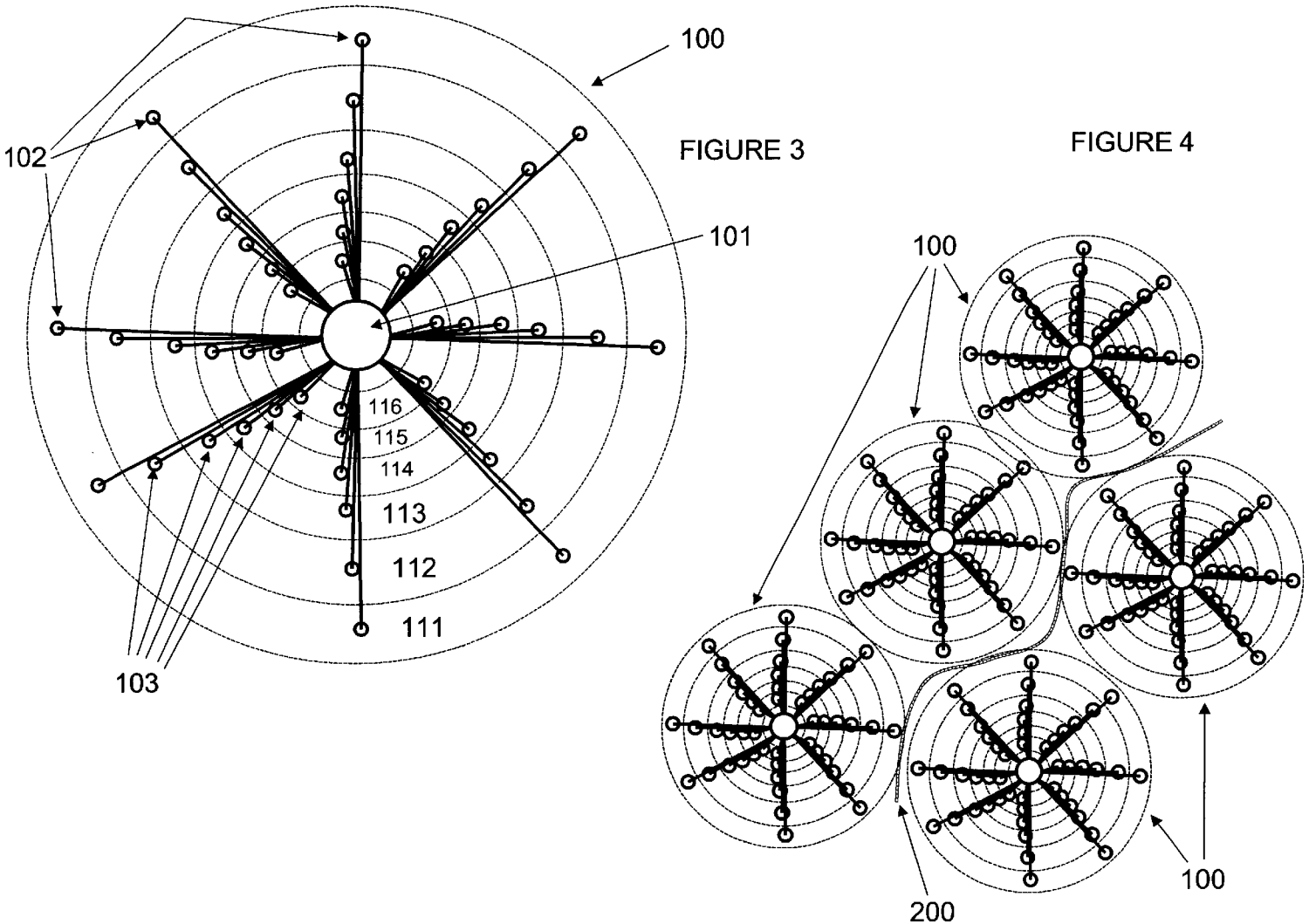
FIG. 3 is a top view of the central Super Daisy Shaft shaft and laterally extending conduits defining zones of outwardly increasing fluid pressure.
FIG. 4 is top view of several adjacent invention fields defining an adjacent field pressure boundary further enhancing the effect of the invention process.

Jet-Stingers 102 as shown in FIGS. 1 and 3 allow delivery of highest pressure fluid, preferably the high temperature and soot free flue gas, optionally with a useful deposit solvent, into zone 111 among the layers the production strata 109, although the pressure and volume of fluid delivered to each production strata in zone 111 depends on establishing and maintaining fluid flow from zone 111 primarily toward zone 118 at the Super Daisy Shaft shaft 101. In the case of sulfur recovery from production strata or pyrolytic gas and steam generation, the highest pressure fluid delivered to zone 111 will be the recovery fluids and/or reaction fluids, i.e., oxygen containing gas for pyrolytic gas and steam generation from coal in the production strata.

FIG. 3 shows only six outwardly extending sets of Jet-Stingers into the zones 111–116. It is intended that in a specific example of the invention process that 400 or more Jet-Stingers with an outside diameter of about 6 inches or less be directionally drilled to the elevations and locations shown in FIGS. 1 and 3 such that zone 111 comprises Far the ends of 70 or more Jet-Stingers 102 and zone 116 comprises 10 or more ends of Jet-Stingers 103 where the balance of the ends of Jet-Stingers 103 are directed substantially equally spatially apart in zones 112–115. A high density of potential fluid delivery and recovery is possible from such high density.

FIG. 4 shows that the invention fields 100 may be located adjacent to each other to the extent of some overlap in their zones 111. An adjacent high pressure barrier 200 is formed so that loss of high pressure gas of the zones 111 to the production strata outside of the zone 111 is minimized.

It is disclosed in U.S. Pat. No. 4,249,775 that explosive charges may be introduced into the end of a directionally drilled Jet-Stinger for effective rubblization of a portion of a formation. It is one preferred embodiment that such rubblization be accomplished in at least a portion of the production strata of zone 111 to improve the pressure enclosure effect of the present invention. Explosion of such charges at the outermost limits of zone 111 cause the formation of a denser formation material about the explosion zone. Rubblization may also be accomplished in zone 111 by judicious use of ram or cyclic high pressure application of the highest pressure fluid into the production strata in zone 111.

It will be understood from the present disclosure that high temperature fluid sweeps from zone 111 into zones 112–117 carrying with it desirable fluids into Jet-Stingers 103 operated with jet pumps to draw to the surface in superstructure 105 and 106 the desirable fluids for separation from the injected fluids and fluids that power the jet pumps. It is preferred that the high temperature and high pressure of the separated injected fluids and fluids that power the jet pumps be preserved by preventing their substantial cooling or pressure reduction. Such separated fluids are then recycled to the Jet-Stingers from which they originated reducing make-up volumes and heating and re-compression utilities for maintaining the present invention production field. It is known in the art that such fluids may be maintained at high pressure and high temperature for recycling to the production strata 109. A stable operation mode of the invention method is obtained by recycling of heated highest pressure fluids from zone 111 to zones 112–117 along the pressure gradient shown in FIG. 2 where the recycling has continued sufficiently long that substantially at least a large portion of at least a single production strata 109 is maintained at elevated temperature. The evidence of that this mode of operation is achievable was demonstrated by the discovery of that old Frasch method deposits maintain their temperature levels once heated to production levels. Once stable operation mode is achieved, utility input is minimized. Injection of solvent and/or hot gas is intended throughout the production strata through Jet-Stingers not in use for recovery of desirable fluids. Where a portion of the desirable fluids appear to be locked in a particularly dense of non-responsive portion of the production strata, localized solvent and/or hot injection are intended so long as the localized pressure does not exceed the zone 111 pressure. It has been found that the invention field 100 comprises 50 to 1000 acres or more depending on the appropriate mining technology for directional and horizontal drilling for the Jet-Stingers. The size (diameter and height) of the Super Daisy Shaft 101 (which includes its supporting shell comprising metal and/or cement walls) can be easily expanded to accommodate a greater number of Jet-Stingers as required for a particular field 100. In an initial estimate using current mining techniques, the invention process in a field 100 is capable of recovering 2–40 million tons of sulfur with up to 95% recovery from production strata.

The invention process may also be conducted in shallow formations where application of high pressures typically needed for recovery could blow out the thin overburden strata. The present invention reduces the maximum pressure required to force desired fluids to the surface with a sweeping action at a potentially much lower pressure. Shallow formation recovery may also be made with Jet-Stingers extending substantially horizontally from a physical wall formed in the shallow formation to a floor strata. The prior art discloses some use of hot water for a sweeping fluid to recover sulfur as in U.S. Pat. Nos. 4,249,775 and 4,869,555, however the prior art has not disclosed development of a highest pressure zone 111 enclosure within which a lower pressure central zone(s) is established by withdrawal of injected fluids in zone 111 so that desirable fluids are recovered from production strata by centripetal fluid sweeping. The highest pressure enclosure prevents loss of components, heat and/or pressure from injected fluids as they are recycled, thereby reducing make-up and utility costs.

It is intended that in a preferred embodiment each of the Jet-Stingers manifolded to sources for hot gas, solvent and jet pump powering fluid in the superstructure 105 and 106 may optionally be separately controllable for those flows so that each Jet-Stinger in field 100 is independently controllable with respect to fluid injection or fluid recovery. As described above, this flexibility permits the operator with precise control over field exploitation by being able to inject an large range of combinations of liquids and/or gases at a range of temperatures and pressures to any Jet-Stinger in the field 100 and recover by jet pump operation desirable fluids from each Jet-Stinger over the range of rates possible for its install jet pump.

Hot gas for injection as a sweeping and/or highest pressure generating medium may be generated by high pressure catalytic combustion of hydrocarbons to obtain a preferably soot free flue gas. The substantial amounts of CO2 are especially helpful in solvation sweeping of crudes from production strata to recovery Jet-Stingers. For recovery materials like crude and sulfur, recovered fluids from each of the Jet-Stingers preferably are combined above ground and separated at high pressure so the flue gas can be re-compressed only to the degree needed for re-injection recycling. Heat absorbed in the formation from the hot gas is preferably replaced before re-injection with high pressure heating of the re-cycled flue gas. The losses of injected fluids are minimized by forming the lowest field 100 pressure near the Super Daisy Shaft shaft 101, although sealing of the production strata from the atmosphere is accomplished with known methods of cement and mastic application to the interface between the overburden strata 108 and the outside of the Super Daisy Shaft shaft shell as well as application of such cements and/or mastics to the holes in the Super Daisy Shaft shaft shell formed for passage of the Jet-Stingers from the inside to the outside of the Super Daisy Shaft shaft shell. Distance between ends of Jet-Stingers is preferably about 10–15 meters.

Recovery of crude is preferably accomplished using vaporized hydrocarbon solvent for the power fluid for the jet pump (as well described in U.S. Pat. No. 4,605,069) so it can be fractionated from the crude for return to the process. Soot free flue gas (about 10–20% CO2 at 350–850F and over 300 psi) is used to maintain the highest pressure in zone 111 at an appropriate level with large volumes of such hot gas and to sweep crude to recovery Jet-Stingers inside the enclosure formed by zone 111. It is a preferred mode of operation to obtain a production strata temperature of above about 200F so that the viscosity of crude is substantially reduced in the presence of CO2 for recovery. Approximately 2000–4000 Btu's per cubic foot of earth is needed for initial heating to production temperatures, where 600–1200 Btu's per cubic foot of earth are removed to the surface with recovered fluids, a major portion of which is returned to the formation by recycling injection fluids with added heat as required to maintain the temperature of the production strata at a desired temperature. In one preferred embodiment, a hydrocarbon solvent is combined with the hot gas so that the solvent is about 3–7 weight percent of the mixture to obtain low crude viscosities.

Recovery of sulfur is preferably accomplished using hot production liquids such as recycled water at a high pressure (to prevent vaporization) to maintain the highest pressure in zone 111. Steam production is accomplished in underground coal deposits with the invention process by injection into zone 111 air or oxygen containing gas at high temperature to create the highest pressure zone and to induce combustion in the production strata, where water is injected into Jet-Stingers 102 and/or some 103 and steam is recovered in recovery Jet-Stingers and delivered to electrical power generation turbines. The condensers from the turbines recover injected water for recycling to the production strata.

The invention process is also useful for generating humic acid and methane from lignite or bituminous coal. It is well known that bacterial digestion of such coals produces humic acid and methane. The Jet-Stingers can be adapted to deliver to the production strata appropriate bacteria containing pulp materials, where an initial phase of production requires production of substantial amounts of methane for injection at the zone 111 for stable and heated operation.

The present invention is now discussed with reference to means for making possible the large number of multi-pipe injection and extraction assemblies side by side in a single shaft Super Daisy Shaft for the several processes described herein. The large number of side by side assemblies has not heretofore been possible because of the difficulty in arranging the headers of the assemblies above ground. No compact header (generally, one that has an effective diameter of less than about 8 inches) has been thought possible to accomplish the objects of the present invention. The objects of the present invention by the large number Super Daisy Shaft are, as described above, hydrocarbon and sulfur recovery, but also include steam generation and biological digestion in situ in the formation, as well as withdrawal of water from a flooded formation.

Figure 7:
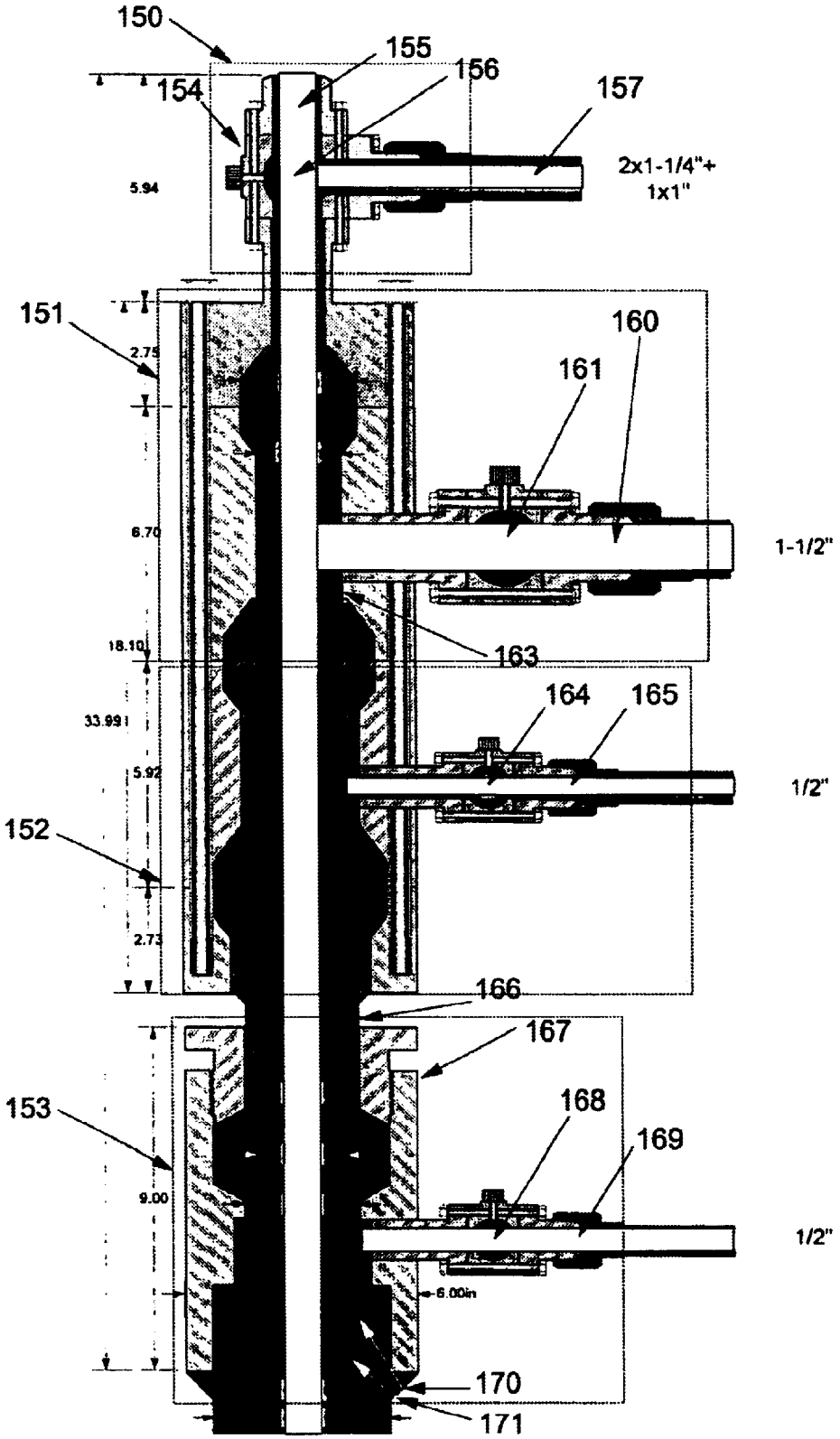
FIG. 7 is a side, cutaway view of a first compact multi-pipe header making possible a large number of multi-pipe injection and extraction assemblies side by side in a single shaft Super Daisy Shaft.

FIGS. 7–10 show four embodiments of the compact header invention. FIG. 7 shows four lateral conduits 157, 160, 165 and 169 having fluid support and access to respectively central pipe 155 at a first junction 156 in top section 150, first annular pipe 163 at a second junction in second section 151, second annular pipe 166 at a third junction in third section 152, third annular pipe 170 at a fourth junction in fourth section 152. Valves 156, 161, 164 and 168 provide fluid control through the conduits. Section 150 contains junction means 154 at the top of the header assembly of FIG. 7. Means 154 comprise a bolted together housing about valve 156, where the bottom portion of the means are a top part of the larger junction means for sections 151 and 152. It will be seen that sections 151 and 152 have three main sections enclosing three separate packing pieces for sealing the conduits against fluid leakage. Section 153 has a cap part in threaded connection with a sleeve part 167 for enclosing a packing piece for forming a seal against loss of fluid in the conduits. The combination of the sections in this particular embodiment provide a maximum of about a 6 inch diameter for the top of the header where the fluid connections of the invention Super Daisy Shaft are formed. It will be appreciated that the top section 150 is relatively lightweight and is supportively based on and directly connected to the more massive sections 151 and 152 assembly. The large diameter pipe 160 is situated at the highest part of the sections 151 and 152 assembly, with the smaller diameter pipe 165 located for juncture at a lower position therein. Thus, the three most interior fluid conduits for the overall assembly are located so that a thread unloosening of the cap part against the packing piece allows the entire upper assembly of sections 150–152 with their accompanying pipes 155, 163 and 166 to be lifted upward to a new position for the end of those pipes in the formation, whereafter the cap part is tightened and operation of the header may be resumed.

Figure 8:
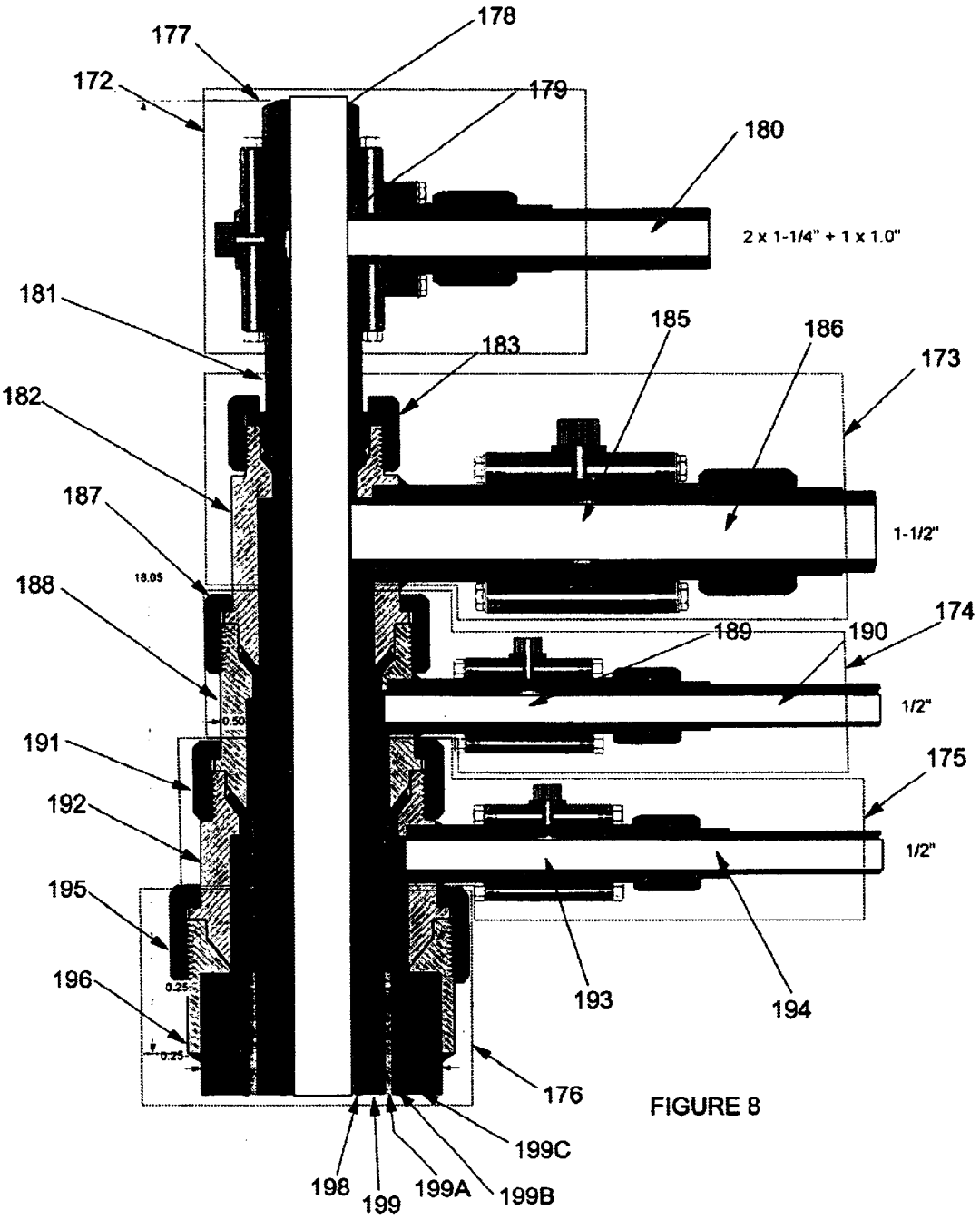
FIG. 8 is a side, cutaway view of a second compact multi-pipe header making possible a large number of multi-pipe injection and extraction assemblies side by side in a single shaft Super Daisy Shaft.

FIG. 8 is another embodiment of a header assembly where all of the conduit junctions and their associated pipes are joined in an efficient, economical and compact manner, although making separate lifting somewhat more difficult. Sections 172–176 are stacked in a top down arrangement so that each lateral conduit or pipe is junctured to a vertical and downward conduit in a most vertically compact arrangement. Section 172 comprises pipe 180 junctured at valve 179 to pipe 178 and sealingly housed in housing means 177, which extends downward to be sealingly directly joined to collar piece 182 by threaded cap 183. The cap 183 tightening forms the sealing force needed to seal section 173 conduits against fluid leakage. Section 173 comprises pipe 186 fluid flow being controlled at valve 185, the extension of pipe 186 thereafter forming a juncture with pipe 199 which forms an annular conduit for fluid flow to a formation. Section 173 supports the section 172 by threaded connection, similarly to the supportive connection of section 173 to section 174, section 174 to section 175, and section 175 to section 176. Section 174 comprises means 187 and 188 similar to means 181 and 182, whereby pipe 190 is controlled at valve 189 and junctured to pipe 199B. Section 175 comprises means 191 and 192 similar to means 181 and 182, whereby pipe 194 is controlled at valve 193 and junctured to pipe 199C. Section 176 comprises sleeve means 195 and 196 without introducing a lateral conduit to the assembly.

Figure 9:
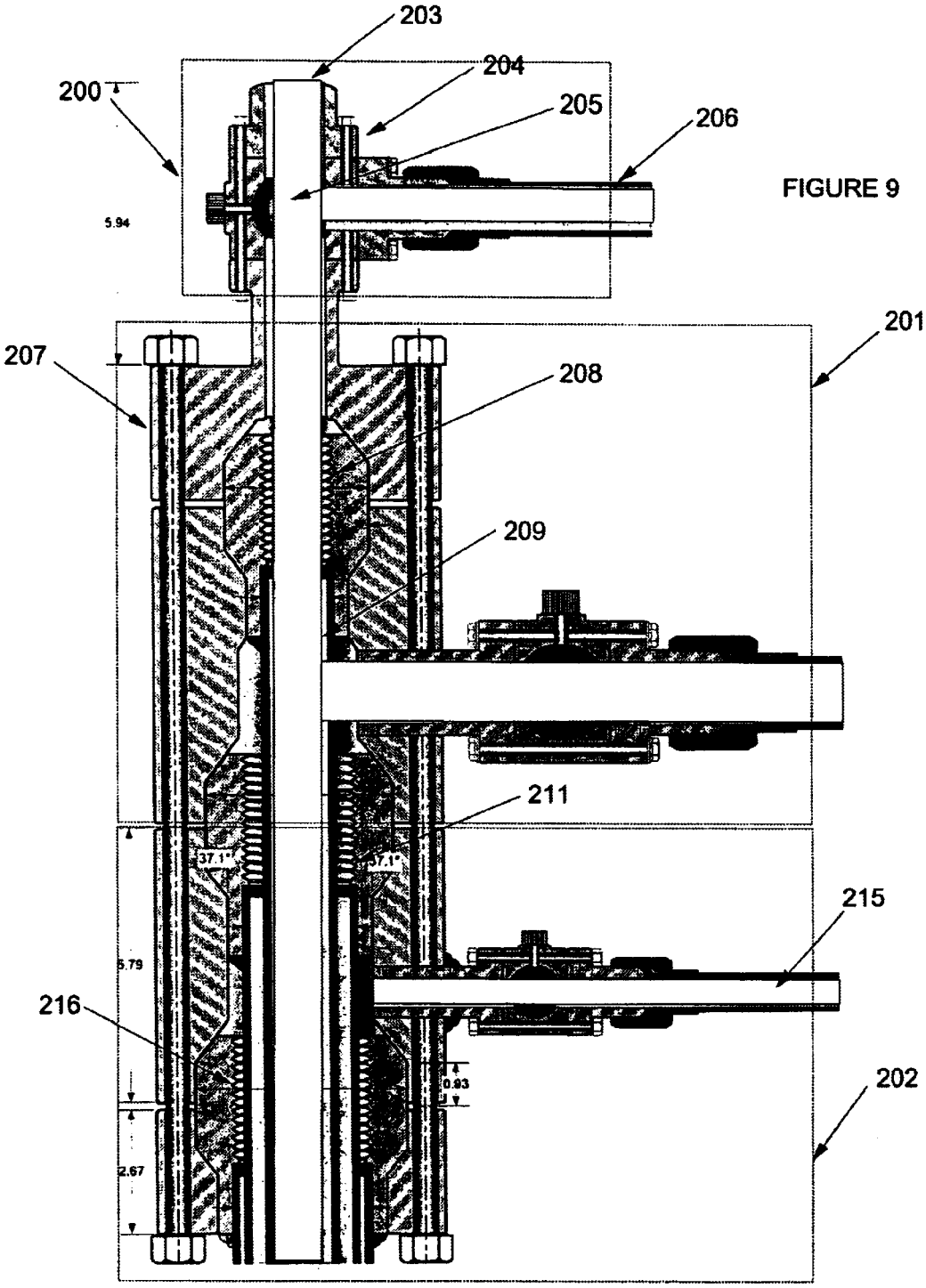
FIG. 9 is a side, cutaway view of a third compact multi-pipe header making possible a large number of multi-pipe injection and extraction assemblies side by side in a single shaft Super Daisy Shaft.

FIG. 9 is an alternate embodiment to that shown in FIG. 7 where expansion pieces 208, 211 and 216 are integrated into the tops of vertical pipes extending downward from them, such as pipes 203/209 having the intervening expansion piece 208 therein. Sections 200, 201 and 202 are analogous to sections 150, 151 and 152 respectively for the assembly of FIG. 7.

Figure 10:
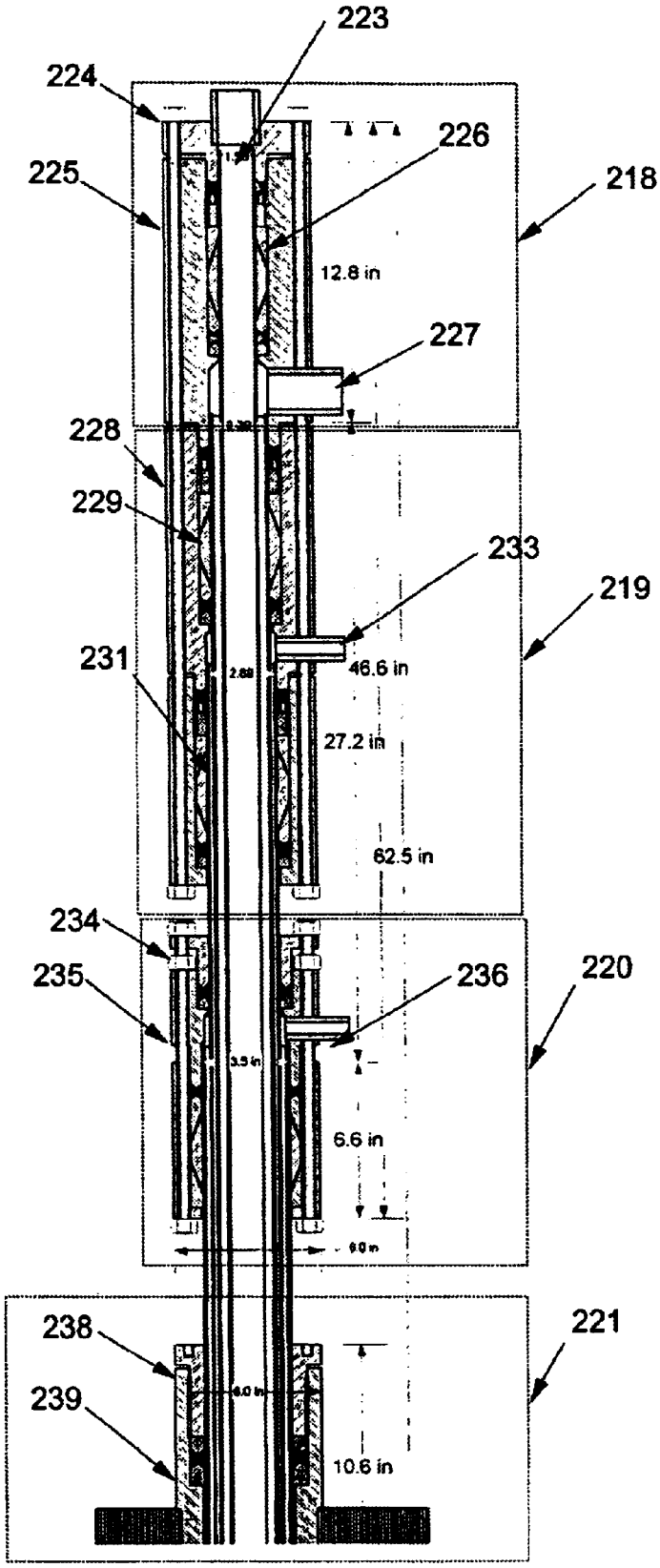
FIG. 10 is a side, cutaway view of a fourth compact multi-pipe header making possible a large number of multi-pipe injection and extraction assemblies side by side in a single shaft Super Daisy Shaft.

FIG. 10 is an embodiment adapted, similar to that of FIG. 7, to permit raising or lowering of a section junction of lateral and vertical pipe sections to accomplish insertion (by addition of more pipe segments) or withdrawal placement of the pipe ends in the formation. Sections 218 and 219 are adapted to be raised and lowered as a unit upon threaded loosening of cap part 234 from collar 235 in section 220 and/or threaded loosening of cap part 238 from collar 239 in section 221. The present embodiment provides for dramatic flexibility in placing the end of the pipes in the formation at any convenient location, subject only to structural and directional drilling requirements. Section 218 comprises lateral pipe 227 sealingly junctured to vertical pipe 223 at means 224 and 225. Section 219 comprises lateral pipe 233 sealingly junctured to vertical pipe 231 at means 228. Sections 218 and 219 are integral as a sealed assembly with appropriate sealing packing such as packing pieces 226 and 229. Section 220 comprises lateral pipe 236 sealingly junctured to vertical pipe for fluid transfer to or from the formation as described above at means 234 and 235. Section 221 comprises means similar to those of section 176 of FIG. 8 to seal the formation-intruding pipes within a housing effective for sealing those pipes from the header to the point at outer wall of the Super Daisy Shaft where those pipes are actually introduced into the formation.

Figure 11:
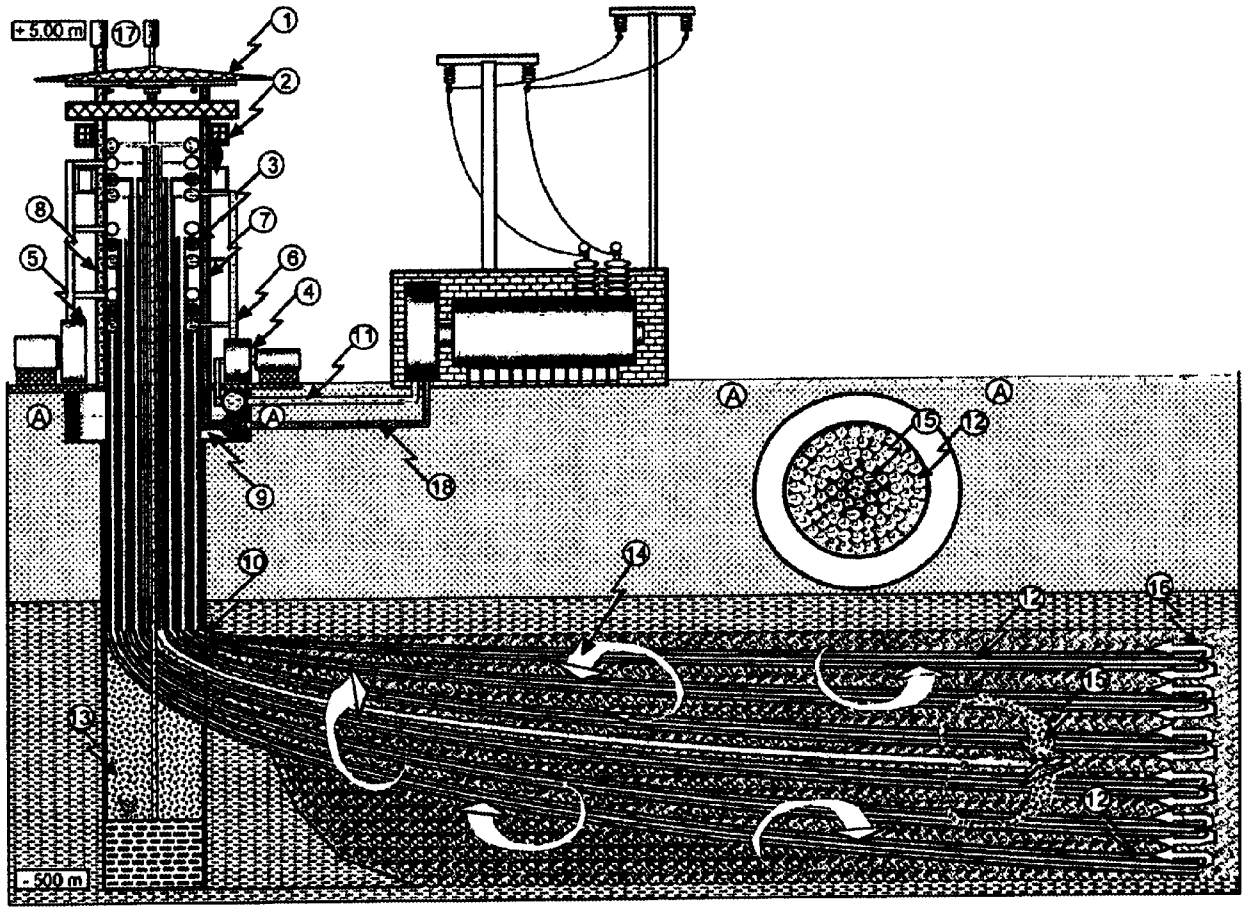
FIG. 11 is a side, cutaway view of a use of the large number of multi-pipe injection and extraction assemblies side by side in a single shaft Super Daisy Shaft for steam generation in situ and its use in power generation.
Figure 12:
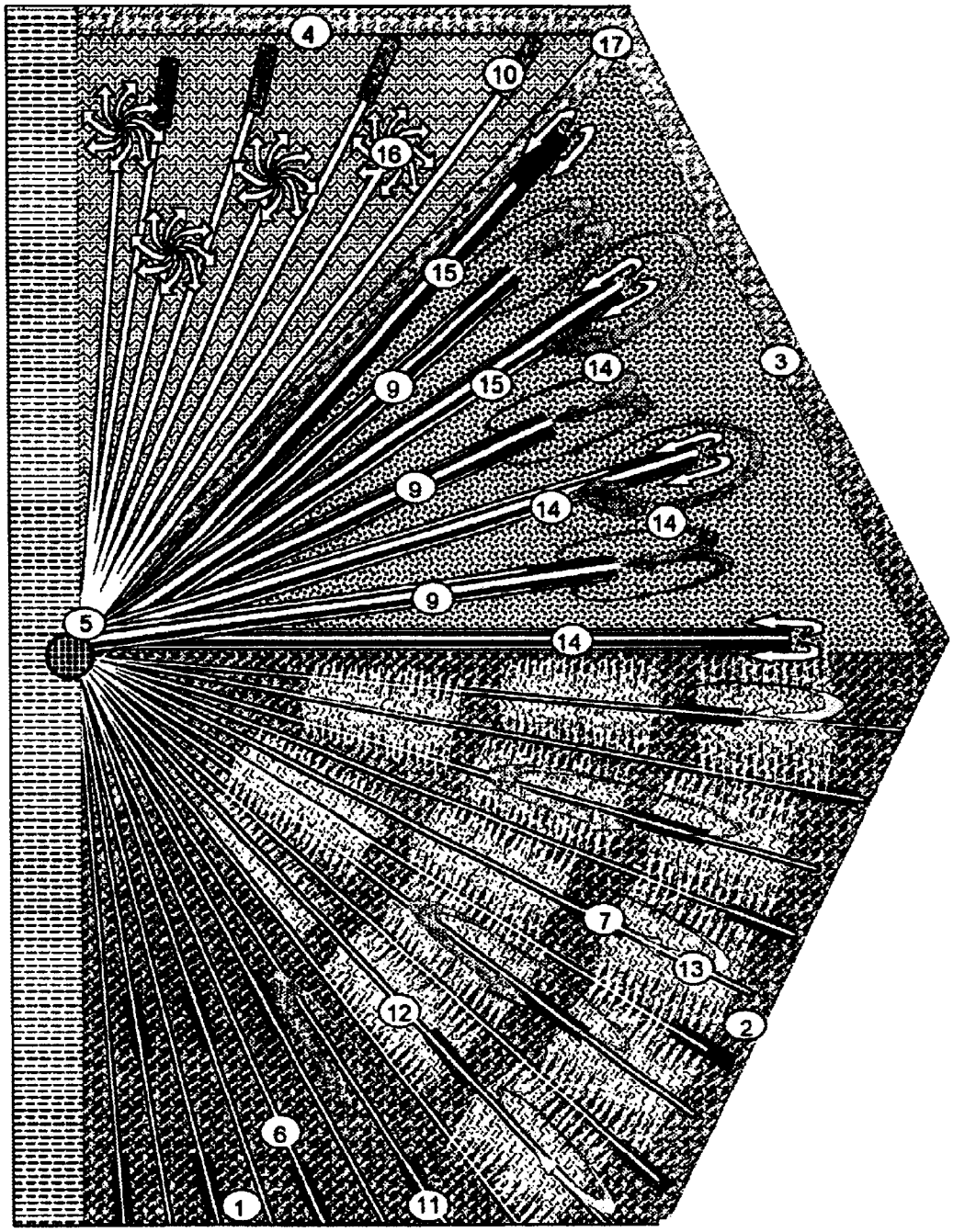
FIG. 12 is a top, cutaway view of the formation for the process shown in FIG. 11.

FIGS. 11 and 12 show side and top cutaway views for a method of steam generation within a formation using the high density Super Daisy Shaft described above. The aspect numbers of FIGS. 11 and 12 apply only to those figures. FIG. 11 shows tower 1 comprising the invention headers arranged in the pyramidal or inverted V-shape to accommodate the very large number of such headers for the invention high density Super Daisy Shaft in ascending levels of header girdles 3. Tower 1 has legs 7 and 8 of heavy gauge pipe so that they have a dual role in support of tower 1 as well as for fluid transfer to or from joining headers that connect the invention headers described above. As described above, multifunctional jet Jet-Stinger wells, such the one shown with annular pipes 12, comprise the invention header, vertical pipes extending downward in a directional guiding sleeve 9 at the pipe exit from the Super Daisy Shaft wall, where after the annular pipes 12 extend with their terminal Roto-Jet, no-impeller pump 5 into the formation layers to a desired depth and radial location away from the Super Daisy Shaft wall. The tower 1 is equipped with a hydraulic lift for extracting and lowering vertical annular pipes in the shaft and consequently in the formation, as well as a tube stretcher and bender for operation of the coiled and joint-less tubing. Each girdle 3 supplies each well with three fluids to separate conduits therein, i.e., pipe 5 delivers pressurized air into the formation at its exit port to provide oxygen for combustion for the steam generation process the deposit; pipe 6 delivers heated water at sufficient pressure for liquid delivery to the formation, where it is preferred that the generated steam be condensed and the liquid water recycled to the formation through this conduit; pipe 18 receives formation produced steam to operate turbines of an electrical generator. Pump raises the pressure of the condensed or fresh water supplied at girdle 3 to a level sufficient for injection into the formation. Cross-section (A—A) shows a multitude of annular pipes of the jet Jet-Stinger wells having vertical double-tubing heat exchangers as optional heat transfer means to the fluids of the jet Jet-Stinger wells and their distribution in Super Daisy Shaft shaft 9. The vertical parts of the annular pipes are jointed at a shaft drilling and its guiding sleeves 10. It is intended that the outermost conduit of the jet Jet-Stinger well within the formation optionally have perforations that permit it to deliver or receive gas for formation operations. Thus, air may be delivered along path 15 for the length of the jet Jet-Stinger well within the formation, or steam and/or flue gases may be removed in path 14. The ability to perform similar functions for an annular pipe system is described in U.S. Pat. No. 4,289,354. In a preferred embodiment, adjacent jet Jet-Stinger wells perform delivery and recovery functions respectively, such as for steam generation, a jet Jet-Stinger well will deliver air and/or water while an adjacent jet Jet-Stinger well will receive generated steam. FIG. 12 Illustrates a top view of horizontal cross-section of the segments 14 of steam production formation, where each segment represents a consecutive phase of operation for steam generation therein. Alternately, as disclosed in U.S. Pat. No. 4,289,354, intra-formation walls 17 may be formed by rubblization by formation explosions, thereby allowing radial sections about the invention high density jet Jet-Stinger well Super Daisy Shaft to be operated in different phases as shown in segments 1–4. Segment 1 shows an initial phase where jet Jet-Stinger wells 11 are drilled and completed for extraction and drainage of excess fluids (such as water) from the deposit through operation of the terminal hydraulic jet-pumps 6. Segment 2 shows a subsequent and second phase of operation where combustion 12 and explosion rubblization are begun while excess liquid removal is completed by jet-pumps 7. Segment 3 shows the third and production phase of operations, where combustion 14 is continued through the operation of the high temperature formation on delivered air and water and recovery of generated steam at wells 14 and 15. A radially shorter set of wells 9 are used to accomplish the functions of wells 14 and 15, although additionally remove excess flue gases as well to quenchers and purifiers at the surface. Segment 4 is the forth and last operation phase, in which post-production wells are used for back-filling of the voids formed by the combustion operation by deliver of water based mineral slurry 16. For improved tight compaction of the sedimentation of the mineral particles in the post-combustion chamber, excess water is removed by wells 10. The central Super Daisy Shaft shaft 5 is shown at the left in FIG. 12.

Figure 13:
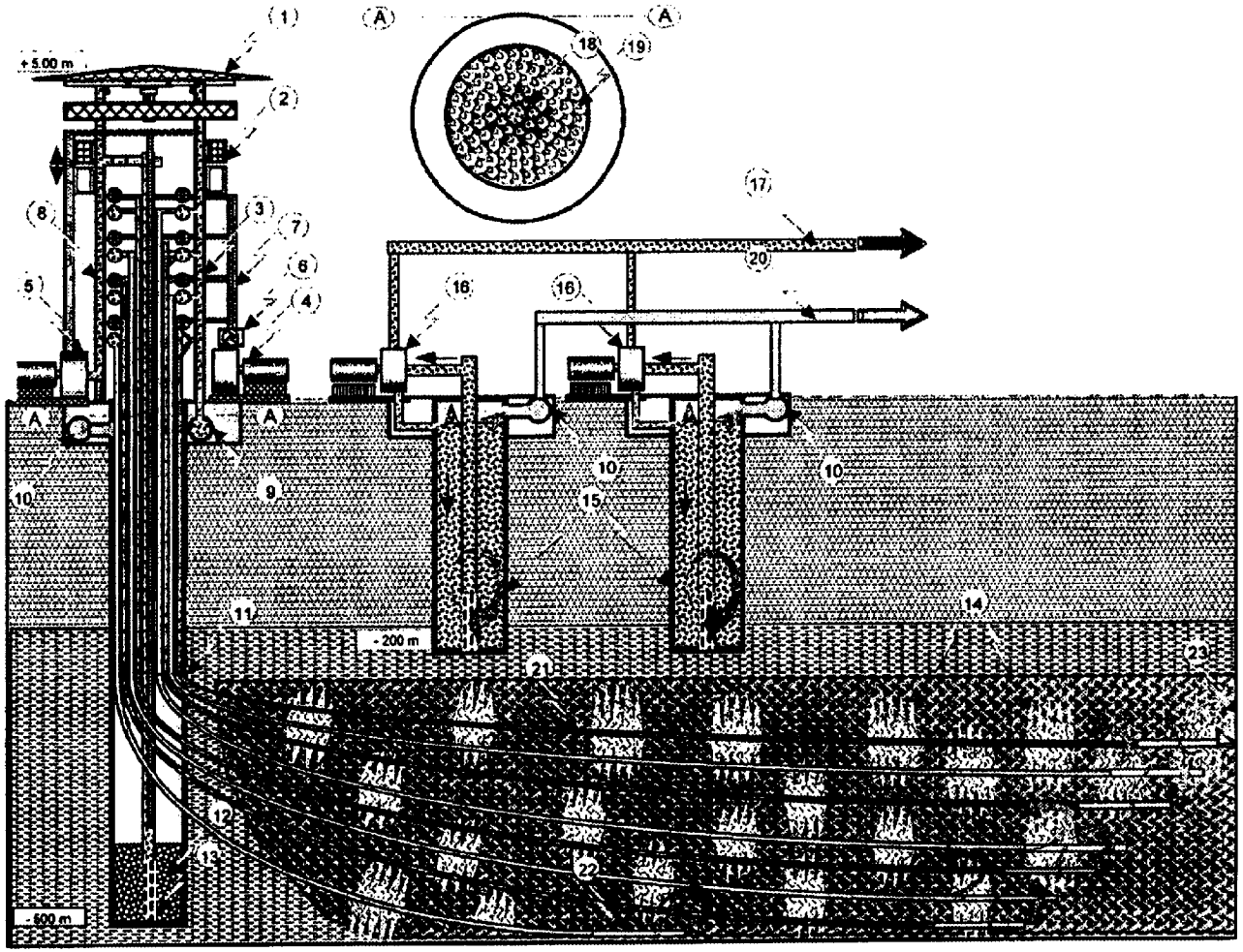
FIG. 13 is a side, cutaway view of a use of the large number of multi-pipe injection and extraction assemblies side by side in a single shaft Super Daisy Shaft for bacterial gas product generation in situ within a formation and recovery of the gaseous product.
Figure 14:
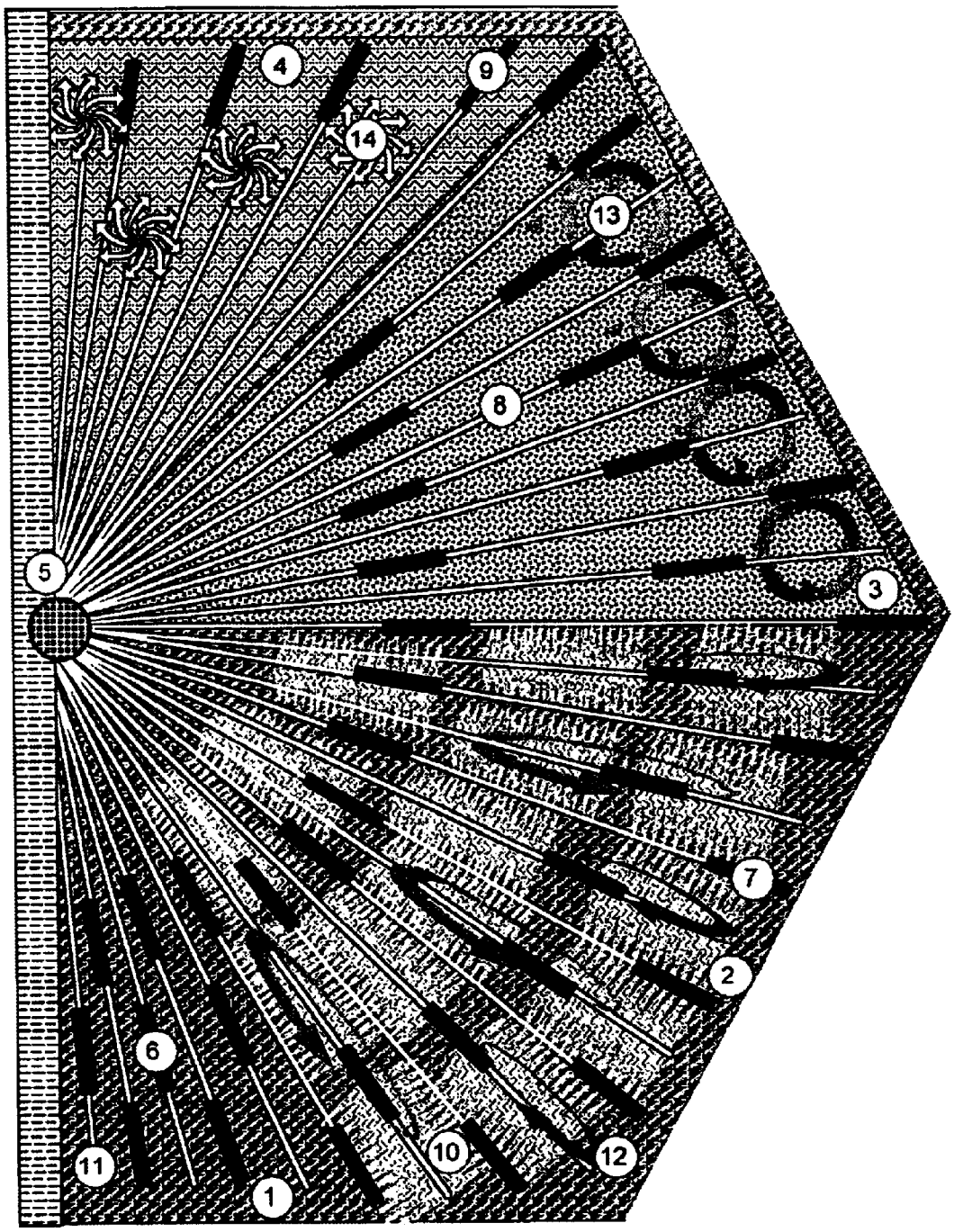
FIG. 14 is a top, cutaway view of the formation for the process shown in FIG. 13.

FIGS. 13 and 14 show side and top cutaway views for a method of biological mining to produce humic acid, a powerful fertilizer, with methane gas, from lignite and/or bituminous coal within a formation using the high density Super Daisy Shaft described above. The aspect numbers of FIGS. 13 and 14 apply only to those figures. FIG. 13 shows tower 1 comprising the invention headers arranged in the pyramidal or inverted V-shape to accommodate the very large number of such headers for the invention high density Super Daisy Shaft in ascending levels of header girdles 3. Tower 1 has legs 7 and 8 of heavy gauge pipe so that they have a dual role in support of tower 1 as well as for fluid transfer to or from joining headers that connect the invention headers described above. As described above, multifunctional jet Jet-Stinger wells, such the one shown with annular pipes 12, comprise the invention header, vertical pipes extending downward in a directional guiding sleeve 9 at the pipe exit from the Super Daisy Shaft shaft wall, whereafter the annular pipes 12 extend with their terminal Roto-Jet, no-impeller pump 5 into the formation layers to a desired depth and radial location away from the Super Daisy Shaft shaft wall. The tower 1 is equipped with a hydraulic lift for extracting and lowering vertical annular pipes in the shaft and consequently in the formation, as well as a tube stretcher and bender for operation of the coiled and joint-less tubing. Each girdle is equipped with a central and an annular pipe for two formation access conduits. These conduits deliver fresh bio-active pulp (live bacteria in a delivery medium) by pump 5, thereby using alternating pressurizations to perform hydraulic ramming-pulsating rubblization of the formation 14. Bacteria are recycled by obtaining bacteria impregnated pulp 23 with use of hydraulic jet pump 22 and Roto-pump 4. Pump 4 pressurize the system and delivers semi-finished product to the "mother load" shaft type digesters 15. Digesters 15 are equipped with circulatory systems 16 and separators for recovery of methane gas, which is recovered in conduits 20. Humic acid is recovered at conduits 17 at the surface. Jet Jet-Stinger wells and their relationship to the tower 1 is as described for the structure and method for FIGS. 11 and 12.

FIG. 14 is a top cutaway view of horizontal cross-section of segments 1–4, having separation walls for each segment as described for the structure and methods of FIGS. 11 and 12. Segment 1 is the initial phase of operations, where wells 11 are drilled and completed for extraction and drainage of excess fluids from deposit by pumps 6. Segment 2 is the second phase of operation, where the wells are subjected to propellant inflagration process 10, while excess fluids are removed by pumps 7. Segment 3 is the third and production phase of operations, where the deposit lignite and/or bituminous coal is digested by bacteria. Humic acid and methane gas are produced thereby. Humic acid is recovered and thereafter recycled through double or triple tubing wells 8.

Segment 4 is the forth and last phase of operations, where post-production wells are used for back-filling of the voids formed by operations.

Figure 15:
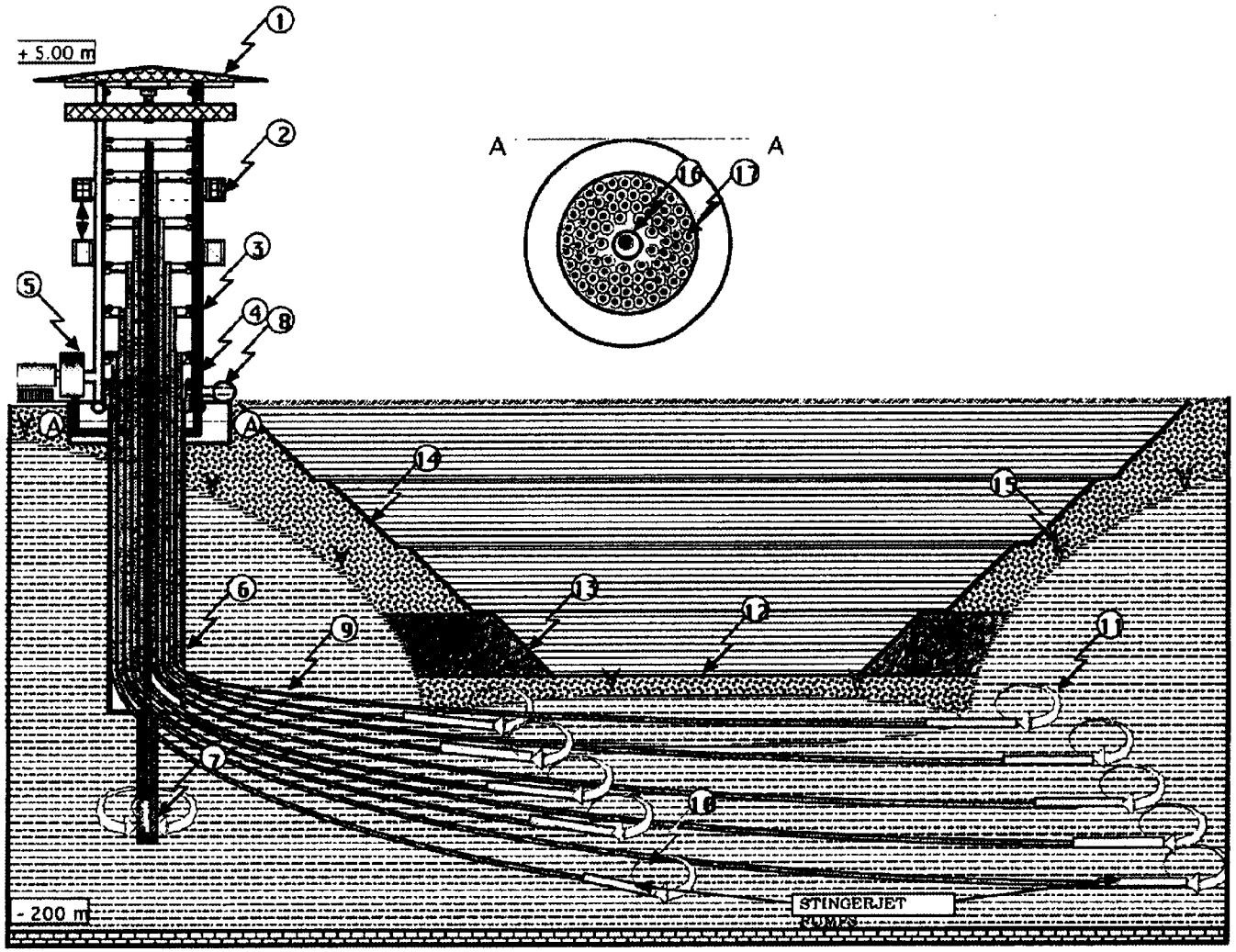
FIG. 15 is a side, cutaway view of a use of the large number of multi-pipe injection and extraction assemblies side by side in a single shaft Super Daisy Shaft for water withdrawal from a flooded formation.

FIG. 15 shows a vertical cross-section showing a method of de-watering of open cast mines or other water submergence problems of large surface excavations. This method is applicable where mineral deposits 13 are submerged in an aquifer, thereafter lowering the ground water 15 to a level below the bottom of the pit 12. The aspect numbers of FIG. 15 apply only to that figure. FIG. 15 shows tower 1 comprising the invention headers arranged in the pyramidal or inverted V-shape to accommodate the very large number of such headers for the invention high density Super Daisy Shaft in ascending levels of header girdles 3. Tower 1 has legs 7 and 8 of heavy gauge pipe so that they have a dual role in support of tower 1 as well as for fluid transfer to or from joining headers that connect the invention headers described above. As described above, multifunctional jet Jet-Stinger wells, such the one shown with annular pipes 12, comprise the invention header, vertical pipes extending downward in a directional guiding sleeve 9 at the pipe exit from the Super Daisy Shaft shaft wall, whereafter the annular pipes 12 extend with their terminal Roto-Jet pump 5 into the formation layers to a desired depth and radial location away from the Super Daisy Shaft shaft wall. The arc tower 1 is equipped with a hydraulic lift for extracting and lowering vertical annular pipes in the shaft and consequently in the formation, as well as a tube stretcher and bender for operation of the coiled and joint-less tubing. Each girdle is provided formation fluid access by wells having a central and an annular pipe, where one conduit supplies power liquid for use of a pump 5. Pump 5 is operated so that the ejected liquid performs a mild cyclic hydraulic ramming-pulsating action that helps to open up the formation and drive back from pump 9 material that could plug it with fine mineral particles of the formation resulting from suffusion processes. The cyclic ramming-pulsating process is performed without removing the hydraulic jet pump from the bottom part of the well, and while the outlet of the second-outlet tube is shut down. After filter cleaning is completed, the draw-down pumping is resumed with use of hydraulic jet pump 9 and Roto-Jet pump 5. Pump 5 pressurizes the entire system. Pump 5 and delivers ground water 11 to the surface reservoirs by pipeline 8.

The above design disclosures present the skilled person with considerable and wide ranges from which to choose appropriate obvious modifications for the above examples. However, the objects of the present invention will still be obtained by the skilled person applying such design disclosures in an appropriate manner.

I claim:

1. A process for forming a pressure barrier enclosure of production strata comprising:

(a) a central shaft shell lining a shaft from a ground surface through overburden strata to near or into production strata;

(b) high pressure conduits and recovery conduits extend from a manifolded connection to injection fluid and/or recovery fluid conduits above the ground surface, into the shell and sealingly and laterally there through to an end location within the production strata, and where the production strata is underlain with a floor strata;

(c) extending the ends of the high pressure conduits laterally most distally to the shell as compared to the ends of the recovery conduits, the ends of high pressure conduits forming an outer perimeter laterally about the shell in the production strata;

(d) injecting injection fluid at approximately a highest pressure into the production strata at the ends of the highest pressure conduits to form the pressure barrier enclosure between the overburden strata and the floor strata;

(e) by way of the recovery conduits removing from the enclosure a collection of desired fluids from the production strata and at least some of the injected fluid to form a lower pressure zone within the enclosure; and (f) the highest pressure injection fluids are heated to above about 300° F. before injection, are collected in part by recovery from the recovery conduits, separated from the desired fluids, re-heated to above about 300° F. and re-injected into the production strata through the high pressure conduits and the enclosure receives a net heat input of above about 2000 Btu's per cubic foot of production strata.

2. The process of claim 1 wherein injected fluids are at least about 50 psi greater than fluids injected within the lower pressure zone.

3. The process of claim 1 wherein the elevations of the ends of the high pressure conduits are substantially different.

4. The process of claim 1 wherein the highest pressure injection fluids are collected from manifolded connections of the recovery conduits and re-injected into the production strata through the high pressure conduits.

5. The process of claim 4 wherein the desired fluids are crude oil.

6. The process of claim 5 wherein the highest pressure injection fluids are hot gases above about 300° F. comprising carbon dioxide and/or solvent.

7. The process of claim 4 wherein the desired fluids is sulfur.

8. The process of claim 7 wherein the highest pressure injection fluids is liquid water.

9. The process of claim 1 wherein flows of injection fluid and/or recovery fluid respectfully to or from the ends of the conduits are independently controllable for each conduit.

10. The process of claim 1 wherein the highest pressure injection fluid comprises an oxygen containing gas at a temperature above which it will oxidize coal or crude.

11. The process of claim 10 wherein the highest pressure injection fluid further comprises water such that the production strata comprises coal or crude and the desired fluid is primarily steam.

12. The process of claim 1 wherein a pressure gradient is established with a highest pressure at the enclosure to a lowest pressure at the shell.

13. The process of claim 1 wherein, before establishment of the enclosure, production strata comprises coal, bacteria adapted to digest coal are injected to the production strata under conditions favoring such digestion, at least methane is produced as a desired fluid and is recovered through at least the recovery conduits, and using the highest pressure injection fluid comprises substantially produced methane to establish the enclosure.

14. The process of claim 13 wherein the desired fluids also comprise substantial amounts of humic acid.

15. The process of claim 1 wherein the highest pressure injection fluid is 300 psi at the manifolded connection.

16. The process of claim 1 wherein the enclosure is adjacent to at least one other enclosure thereby forming a reinforced enclosure zone so that loss of highest pressure injection fluid to production strata outside the enclosure is reduced.

17. The process of claim 1 wherein a substantially constant temperature is established in at least a portion of the production strata where highest pressure injection fluid flows from the enclosure toward the shell.

* * * * *